US007342499B2

(12) United States Patent
Chiu et al.

(10) Patent No.: US 7,342,499 B2
(45) Date of Patent: Mar. 11, 2008

(54) MULTI-BAND RFID ENCODER

(75) Inventors: Lihu M. Chiu, Arcadia, CA (US); Hai Cao, Orange, CA (US); John Kinley, Costa Mesa, CA (US)

(73) Assignee: Printronix, Inc., Irvine, CA (US)

( * ) Notice: Subject to any disclaimer, the term of this patent is extended or adjusted under 35 U.S.C. 154(b) by 168 days.

(21) Appl. No.: 11/340,234

(22) Filed: Jan. 26, 2006

(65) Prior Publication Data

US 2007/0171071 A1 Jul. 26, 2007

(51) Int. Cl.
*G08B 13/14* (2006.01)

(52) U.S. Cl. ..... 340/572.7; 340/572.4; 340/572.8

(58) Field of Classification Search ..... 340/572.1, 340/572.4, 572.7, 572.8, 568.1; 343/700 MS, 343/895; 333/26, 33; 607/36, 60
See application file for complete search history.

(56) References Cited

U.S. PATENT DOCUMENTS

| | | | | |
|---|---|---|---|---|
| 5,861,019 | A * | 1/1999 | Sun et al. | 607/60 |
| 6,667,725 | B1 * | 12/2003 | Simons et al. | 343/895 |
| 6,822,528 | B2 * | 11/2004 | Dawn et al. | 333/26 |
| 2006/0255945 | A1 * | 11/2006 | Egbert | 340/572.7 |
| 2007/0040680 | A1 * | 2/2007 | Chiu | 340/572.1 |

* cited by examiner

*Primary Examiner*—Van T. Trieu
(74) *Attorney, Agent, or Firm*—Jonathan W. Hallman; MacPherson Kwok Chen & Heid LLP

(57) ABSTRACT

In one embodiment, a multi-band near-field antenna for an RFID encoder includes a substrate; an internal coil antenna defined within the substrate; an annular ground plane defined on a first surface of the substrate; a second ground plane defined on an opposing second surface of the substrate, wherein the annular ground plane and the second ground plane form a Faraday cage for the internal coil antenna; and a second antenna disposed on the opposing second surface within the annulus defined by the annular ground plane.

14 Claims, 2 Drawing Sheets

MULTI-BAND RFID ENCODER

TECHNICAL FIELD

This invention relates to RFID applications. More particularly, the present invention relates to a multi-band near-field RFID encoder.

BACKGROUND

Radio Frequency Identification (RFID) systems represent the next step in automatic identification techniques started by the familiar bar code schemes. Whereas bar code systems require line-of-sight (LOS) contact between a scanner and the bar code being identified, RFID techniques do not require LOS contact. This is a critical distinction because bar code systems often need manual intervention to ensure LOS contact between a bar code label and the bar code scanner. In sharp contrast, RFID systems eliminate the need for manual alignment between an RFID tag and an RFID reader or interrogator, thereby keeping labor costs at a minimum. In addition, bar code labels can become soiled in transit, rendering them unreadable. Because RFID tags are read using RF transmissions instead of optical transmissions, such soiling need not render RFID tags unreadable. Moreover, RFID tags may be written to in write-once or write-many fashions whereas once a bar code label has been printed further modifications are impossible. These advantages of RFID systems have resulted in the rapid growth of this technology despite the higher costs of RFID tags as compared to a printed bar code label.

Generally, in an RFID system, an RFID tag includes a transponder and a tag antenna, which communicates with an RFID transceiver pursuant to the receipt of a signal, such as an interrogation or encoding signal, from the RFID interrogator. As suggested by the name "RFID," the encoding signal is a transmitted RF signal. The transmitted RF signal causes the RFID transponder to emit via the tag antenna a signal, such as an identification or encoding verification signal, which is received by the RFID interrogator. In passive RFID systems, the RFID tag has no power source of its own and therefore the interrogation signal from the RFID interrogator also provides operating power to the RFID tag.

Currently, a commonly used method for encoding the RFID tags is by way of an inductively coupled antenna comprising a pair of inductors or transmission lines placed in proximity of the RFID transponder to provide operating power and encoding signals to the RFID transponder by way of magnetic coupling. Magnetic coupling, however, is not without shortcomings. Magnetic coupling generally depends on the geometry of the RFID tag, such as the shape of the tag antenna, transponder, etc, so an often complex process for determining an optimal alignment of transceiver with the RFID tag is necessary for effectively directing the magnetic field between the transceiver and the RFID tag such that their magnetic fields would couple. Furthermore, this process has to be redone if the transceiver is be used for encoding an RFID tag of a different geometry, due to a different shape or a different orientation with respect to the pair of inductors when placed in proximity of the RFID transponder.

An attractive alternative to magnetically-coupled RFID encoding schemes are near-field encoders such as capacitively-coupled RFID encoders. For example, U.S. patent application Ser. No. 11/207,222 (the '222 application) filed Aug. 19, 2005, the contents of which are incorporated by reference herein in their entirety, describes a capacitively-coupled RFID encoder. Unlike conventional near-field capacitively-coupled encoders, the encoder described in the '222 application requires no modification to the encoded tag. In contrast, conventional near-field techniques typically require the RFID tag antenna to be modified with capacitive plates. However, the '222 application describes a stripline antenna having enhanced near-field coupling capability such that unmodified RFID tags are readily near-field-encoded. Moreover, the stripline approach described in the '222 application provides inherent impedance matching and optimal non-resonant excitation capabilities.

Despite the advances disclosed in the '222 application, there remain unfulfilled needs in the art. For example, despite the advantages of RFID technology over the bar code arts, users still desire a bar code label on goods identified using RFID tags. Thus, industrial bar code printers have been developed that incorporate near-field RFID encoders as well. As goods pass by such a printer, they receive both an encoded-RFID tag as well as a corresponding bar code label. The un-encoded RFID tags for the near-field encoder are generally stored in a roll akin to a roll of stickers in that the RFID tags typically have an adhesive backing. Conventional RFID tags are sized into approximately 4 inch by 6 inch rectangular shapes. Even if such tags are placed relatively close to one another on their roll, the corresponding centers of RF reception for such conventional tags are thus separated by 4 to 6 inches. Because of this relatively wide separation, the near-field encoder may successfully encode a given tag without encoding neighboring tags.

A problem arises, however, as RFID tag dimensions are continually reduced. For example, RFID tags have been developed that are only ⅜ of an inch in diameter. The relatively wide separation between centers of RF reception on the RFID tag roll discussed previously is thus dramatically reduced. Because the pitch between RFID tags is now much smaller, a near-field encoder has difficulty encoding a given tag on the roll without encoding neighboring tags. Moreover, this problem is exacerbated as the RF sensitivity of modern RFID tags is increased.

Accordingly, there is a need in the art for near-field encoders adapted to encode small pitch RFID tags without stray encoding of neighboring tags.

SUMMARY

In accordance with an aspect of the invention, a multi-band near-field antenna for an RFID encoder is provided, comprising: a substrate; an internal coil antenna defined within the substrate; an annular ground plane defined on a first surface of the substrate; a second ground plane defined on an opposing second surface of the substrate, wherein the annular ground plane and the second ground plane form a Faraday cage for the internal coil antenna; and a second antenna disposed on the opposing second surface within the annulus defined by the annular ground plane.

DETAILED DESCRIPTION

Reference will now be made in detail to one or more embodiments of the invention. While the invention will be described with respect to these embodiments, it should be understood that the invention is not limited to any particular embodiment. On the contrary, the invention includes alternatives, modifications, and equivalents as may come within the spirit and scope of the appended claims. Furthermore, in the following description, numerous specific details are set forth to provide a thorough understanding of the invention. The invention may be practiced without some or all of these specific details. In other instances, well-known structures and principles of operation have not been described in detail to avoid obscuring the invention.

The disclosed near-field antenna is enhanced to shape its near-field radiation such that a selected tag may be encoded while adjacent tags contained on a roll of small-pitch RFID tags are not excited. Advantageously, multi-band embodiments of this enhanced near-field antenna are disclosed. In a first frequency band of operation, the multi-band antenna may magnetically encode low frequency (such as 13.56 MHz) tags. In a second frequency band of operation, the multi-band antenna may electrically encode high frequency (such as 900 MHz) tags. It will be appreciated, however, that the near-field shaping techniques disclosed herein may be applied to single-band antennas as well.

In one embodiment, the multi-band near-field antenna includes both a coil for magnetically encoding low frequency (such as 13.56 MHz) tags as well as an antenna for electrically encoding high frequency (such as 900 MHz) tags. In contrast to conventional encoder antennas, the high frequency antenna does not use electromagnetic propagation of an RF signal to encode the high frequency tags. Instead, the high frequency antenna couples through the near field using only the electric field to encode high frequency tags. To prohibit stray near-field or far-field coupling to adjacent tags, the coil may be shielded with a Faraday cage. The dimensions of the Faraday cage may be adjusted so that the electric field emanations from the high frequency antenna are focused in a desired direction.

Figure 1:
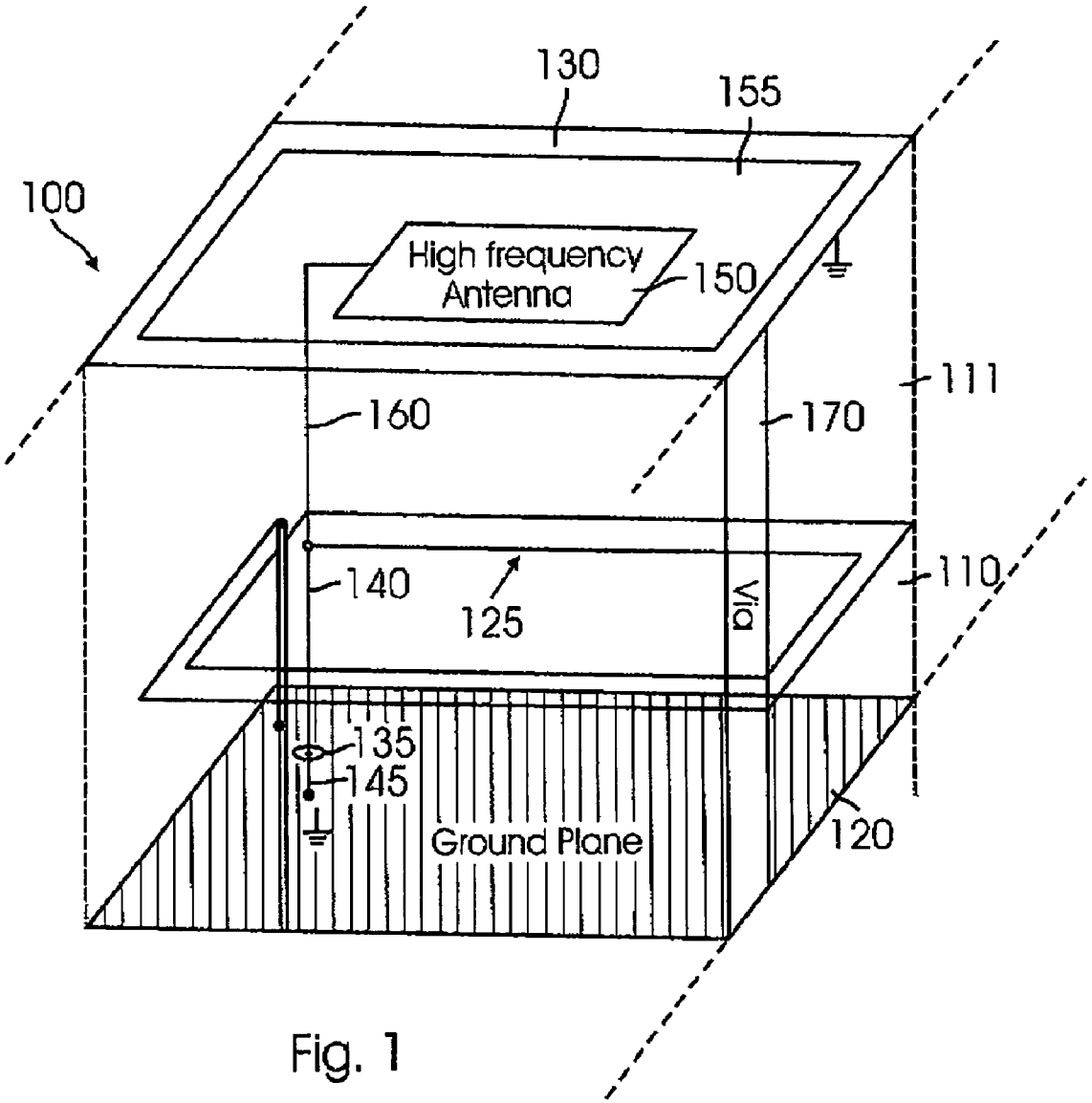
FIG. 1 illustrates a cross sectional view, partially cutaway, of a multi-band near-field antenna in accordance with an embodiment of the invention.

Turning now to FIG. 1, an exemplary embodiment of a multi-band near-field antenna 100 is illustrated. As seen in this cross-sectional view, a first substrate 110 includes a ground plane 120. A coil 125 may be defined either on first substrate 110 or a second substrate 111. In that regard, substrates 110 and 111 may form a conventional integrated circuit board such as FR4 that provides for at least one internal metal layer that will support the coil. An annular ground plane 130 on substrate 111 in combination with ground plane 120 form a Faraday cage with regard to the coil. Thus, annular ground plane 130 may generally match the dimensions of the coil to ensure adequate shielding. For example, should the coil be generally rectangular, the annular ground plane would have the same general rectangular shape. Alternatively, should the coil be generally circular, the annular ground plane would have a corresponding generally circular shape. As known in the electrical arts, the resulting Faraday cage formed by ground planes 120 and 130 allow only a magnetic field to emanate from coil 125.

Any suitable feed may be used to provide an encoding signal to coil 125. For example, a coax feed 135 may couple to the coil through a via 140. Similarly, ground plane 120 may couple to the coax feed through a via 145. Ground plane 130 may be grounded through a via connection 170 to ground plane 120. Alternatively, ground plane 130 may be grounded through a via connection (not illustrated) directly to the coax feed. Advantageously, the coax feed may also couple to a high frequency antenna 150 formed within an cavity 155 defined by annular ground plane 130. High frequency antenna 150 may be any suitable antenna such as a dipole or monopole. For example, high frequency antenna 150 may comprise a fractal antenna manufactured by Fractus. High frequency antenna 150 couples to coax feed 135 through a via 160.

Note the advantage of having coaxial feed 135 simultaneously couple to both the coil and the high frequency antenna. The multi-band RFID encoder (not illustrated) need merely feed both its low frequency and high frequency encoding signals into the coaxial feed cable. Because of its resonant behavior, the high frequency antenna will not respond to a low frequency encoding signal (more specifically, its response is not sufficient to near-field encode any adjacent high frequency RFID tags). Similarly, the coil will not respond to the high frequency encoding signal. In this fashion, the multi-band RFID encoder need employ no physical switching of feeds when alternating between high and low frequency band operation. It will be appreciated, however, that separate feeds could be implemented with regard to the coil and the high frequency antenna.

Figure 2:
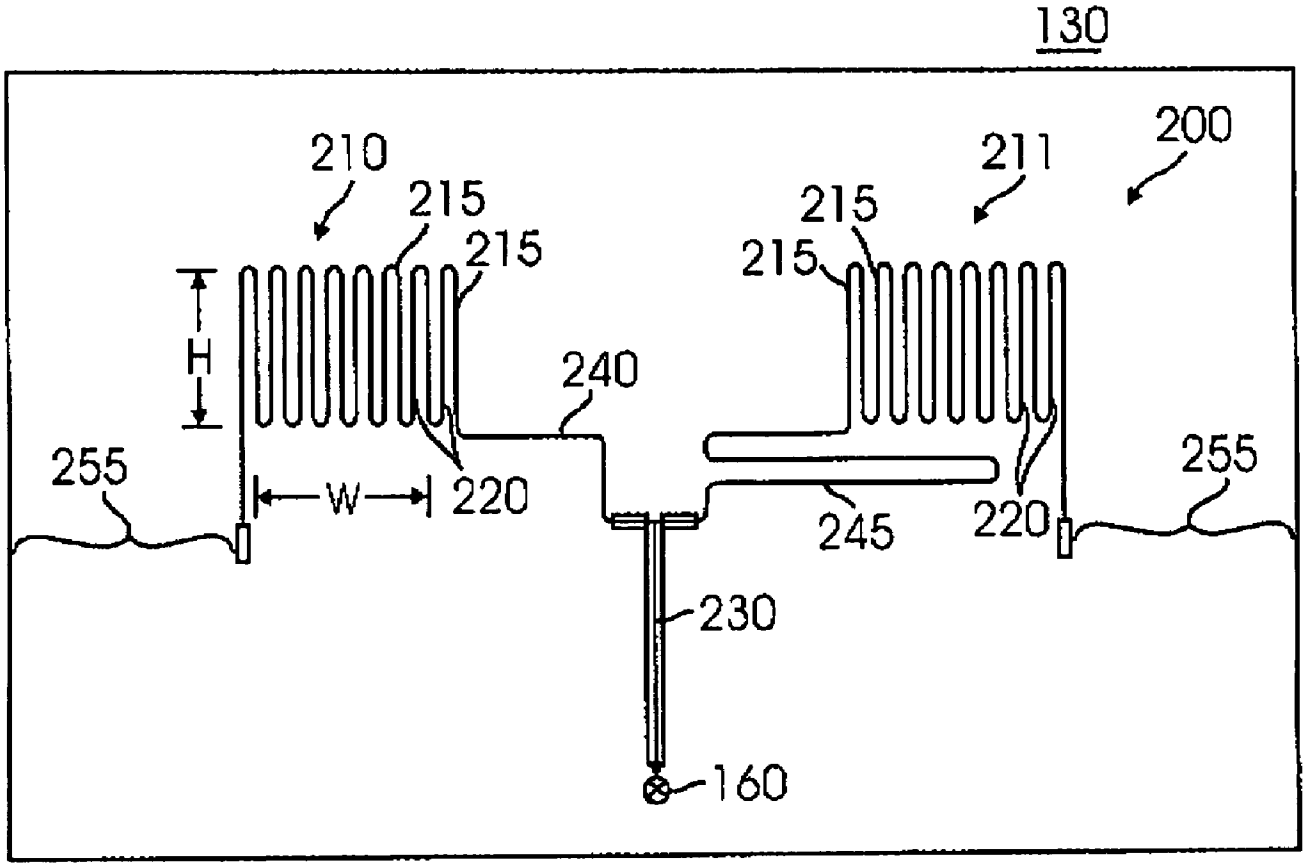
FIG. 2 is a plan view of the near-field antenna of FIG. 1 wherein the high-frequency antenna comprises a stripline antenna in accordance with an embodiment of the invention.

As discussed earlier, the '222 application discloses an advantageous stripline antenna which provides for high efficiency near-field capacitive coupling. Turning now to FIG. 2, a top view of substrate 111 is shown for an embodiment of antenna 100 in which the high-frequency antenna comprises a stripline antenna 200. It will be appreciated that the terms "stripline" is being used in a non-standard fashion such that the conductors forming antenna 200 would be more formally denoted as "microstrip." Stripline antenna 100 forms a first capacitive element 210 and a second capacitive element 211. Should the RFID tag being encoded use a dipole antenna, each element 210 and 211 are preferably oriented over corresponding halves of the RFID tag's dipole antenna. More generically, elements 210 and 211 should preferably be oriented over corresponding areas of expected high current density in the RFID tag's antenna However, because the capacitive coupling for stripline antenna 200 is so efficient, the orientation of elements 210 and 211 with regard to the RFID tag antenna being encoded need only be approximate. In other words, merely positioning elements 210 and 211 sufficiently proximate the RFID tag antenna being encoded is typically adequate.

Each capacitive element 210 and 211 comprises a meandering stripline. For example, each capacitive element may include opposing stripline portions 215 and 220. Because this stripline portions run in opposing directions, the magnetic fields they excite are cancelled such that portions 215 and 220 appear as a resistive and capacitive load. To excite capacitive elements 210 and 211, an RF signal is coupled to a feed stripline 230 through via 160 (as described with respect to FIG. 1). A connector stripline 240 couples the RF excitation on feed stripline 230 to capacitive element 210. A connector stripline 245 that couples the RF excitation on feed stripline 230 to capacitive element 211 is extended with respect to connector stripline 240 so as to induce a desired phase shift between the excitations to elements 210 and 211. It will be appreciated that if capacitive elements 210 and 211 were fed in-phase, there would be no voltage potential that exists between these elements. Thus, there would be no capacitive coupling to an RFID tag antenna in such an instance. However, because stripline connectors 240 and 245 have different electrical lengths, the elements 210 and 211 are excited out of phase with respect to each other. In this fashion, a voltage exists between these elements that provides the energy to capacitively encode an adjacent RFID tag. Rather than use stripline conductors of different length, it will be appreciated that a variable phase-shifter could also be implemented. In this fashion, the phase difference between the excitation of elements 210 and 211 could be made adaptive.

Each stripline capacitive element 210 and 211 is separated by a gap 255 from annular ground plane 130. As seen in the cross-sectional view of FIG. 1, stripline capacitive elements 210 and 211 are also separated the thicknesses of substrates 110 and 111 from ground plane 120. Referring back to FIG. 2, the combined thicknesses of substrates 210 and 211 determines a desired minimum separation between opposing stripline portions 215 and 220. For example, suppose the width for each stripline portion 215 and 220 is such that each portion has a characteristic impedance of 100 Ω. As the separation between opposing stripline portions 215 and 220 is reduced, this characteristic impedance would be affected-clearly, as the separation goes to zero, the characteristic impedance of each element 210 and 211 would be that of a capacitive plate in that the stripline portions would merge into a solid plate. Thus, by keeping the minimum separation between opposing stripline portions to be at least the separation between elements 210 and 211 and ground plane 120, the characteristic impedance for stripline antenna 200 is maintained at a desired level. As illustrated, opposing stripline portions 215 and 220 are arranged in parallel such that current through these portions alternate in direction by 180 degrees. For example, if the portions are assumed to be parallel to the z direction, the current alternates from the +z to the −z direction and vice versa. In this fashion, a magnetic field excited by a portion having current in the +z direction is substantially cancelled by the current flowing through an adjacent portion in the −z direction. It will be appreciated that these advantages may also be obtained using alternative arrangements of stripline portions. For example, a zig-zag or fractal pattern may be used to construct a stripline capacitive element.

Note the advantages of using opposing stripline portions 215 and 220 to form stripline capacitive elements 210 and 211. For example, consider the case should stripline portions 215 and 220 be replaced by a corresponding solid conductive plate that covers the same height H and width W such as shown for element 210. Because a conductive plate will have a much lower resistance than stripline connectors 240 and 245, there would be a significant impedance mismatch that would reduce the amount of power that could be coupled into the conductive plate. Thus, a multi-band near-field antenna that incorporates capacitive elements 210 and 211 formed from opposing stripline portions will require less power than an equivalent antenna that uses plates. Moreover, because of the poor power transfer in a capacitive plate system (resulting from the impedance mismatches), the dielectric thickness for such systems must be substantially greater to achieve the same encoding power. In contrast, substrates 110 and 111 may be relatively thin, for example, a thickness of 32 mils, which lowers manufacturing costs. In addition, the use of stripline leads to a natural impedance matching—for example, feed stripline 230 may have a width to produce a desired characteristic impedance such as 50 Ω. Connector stripline portions 240 and 245 may then have one-half the width used for feed stripline 230 to provide a characteristic impedance of 100 Ω. Because connector stripline portions 240 and 245 are in parallel with respect to ground, their effective impedance with respect to feed stripline 230 is still 50 Ω, thus providing a matched feed. In turn, opposing stripline portions 215 and 220 may simply have the same width (and thus same characteristic impedance) as connector stripline portions 240 and 245.

The symmetry of the annular ground plane with respect to the high frequency antenna determines the direction of the near-field capacitive electrical energy. For example, if the annular ground plane is completely symmetric as shown in FIG. 1, the radiation from the high frequency antenna will be normally directed with to the center of cavity 155. The magnetic energy from the coil will be similarly directed. However, industrial applications may call for rapid encoding of RFID tags on the roll. For example, goods may be flowing past the RFID encoder/bar code printer at speeds in excess of 20 mph. As these goods pass, the encoder, the relationship of the printer head and the RFID encoder may require the high frequency radiation to be tilted with respect to the normally-directed radiation discussed with regard to FIG. 1. A non-symmetric annular ground plane will provide a near-field energy radiation that is not normally-directed.

The above-described embodiments of the present invention are merely meant to be illustrative and not limiting. It will thus be obvious to those skilled in the art that various changes and modifications may be made without departing from this invention in its broader aspects. Therefore, the appended claims encompass all such changes and modifications as fall within the true spirit and scope of this invention.

What is claimed is:

1. A multi-band near-field RFID encoder, comprising:

a substrate;

an internal coil antenna defined within the substrate;

an annular ground plane defined on a first surface of the substrate;

a second ground plane defined on an opposing second surface of the substrate, wherein the annular ground plane and the second ground plane form a Faraday cage for the internal coil antenna; and a second antenna disposed on the opposing second surface within the annulus defined by the annular ground plane.

2. The multi-band near-field RFID encoder of claim 1, further comprising:

a coaxial feed coupled to the internal coil antenna and the second antenna.

3. The multi-band near-field RFID encoder of claim 2, wherein the annular ground plane and the second ground plane couple to a ground within the coaxial feed.

4. The multi-band near-field RFID encoder of claim 1, wherein the second antenna includes: a first plurality of serially-connected stripline conductors on the second surface of the substrate, the serially-connected stripline conductors in the first plurality being arranged within a first area of the second surface, and a second plurality of serially-connected stripline conductors on the second surface of the substrate, the serially-connected stripline conductors in the second plurality being arranged within a second area of the second surface, the encoder being configured to drive the first plurality of serially-connected stripline conductors with an RF signal and to drive the second plurality of serially-connected stripline conductors with a phase-shifted version of the RF signal.

5. The multi-band near-field RFID encoder of claim 4, wherein each of the stripline conductors in the first and second plurality is arranged in parallel with the remaining stripline conductors.

6. The multi-band near-field RFID encoder of claim 4, wherein the first and second plurality of stripline conductors are each arranged in a fractal pattern.

7. The multi-band near-field RFID encoder of claim 1, further comprising:

a stripline feed on the second surface for receiving the RF signal;

a first connector stripline connecting the stripline feed to the first plurality of stripline conductors so that the first plurality of stripline conductors is driven with the RF signal; and a second connector stripline connecting the stripline feed to the second plurality of stripline conductors, wherein the second connector stripline has a different length than the first connector stripline so that the second plurality of stripline conductors is driven with the phase-shifted version of the RF signal.

8. The multi-band near-field RFID encoder of claim 4, further comprising a variable phase shifter for providing the phase-shifted version of the RF signal.

9. The capacitive encoder of claim 4, wherein a spacing between each of the stripline conductors in the first plurality is at least as large as a thickness of the substrate, and wherein a spacing between each of the stripline conductors in the second plurality is at least as large as the thickness of the substrate.

10. The capacitive encoder of claim 4, wherein a characteristic impedance for the stripline conductors in the first and second plurality is at least 50 Ω.

11. A system comprising:

a bar code printer;

a capacitive near-field RFID encoder integrated with the bar code printer, wherein the capacitive RFID encoder includes:

a substrate having a first ground plane on a first surface;

a plurality of capacitive elements on an opposing second surface of the substrate, each capacitive element including a plurality of serially-connected stripline conductors, the RFID encoder being configured to drive a first selected one of the capacitive elements with an RF signal and to drive a second selected one of the capacitive elements with a phase-shifted version of the RF signal; and an annular ground plane on the opposing second surface, the annular ground plane surrounding the capacitive elements.

12. The system of claim 11, wherein the annular ground plane is symmetrically arranged with regard to plurality of capacitive elements.

13. The system of claim 11, wherein the annular ground plane is substantially rectangular, and wherein one side of the annular ground plane has a first width and the remaining sides of the annular ground plane have a second width.

14. The system of claim 11, further comprising:

a coil antenna defined within the substrate, wherein the annular ground plane and the first ground plane form a Faraday shield for the coil antenna.

* * * * *